United States Patent [19]

Perry

[11] Patent Number: 4,765,037

[45] Date of Patent: Aug. 23, 1988

[54] PACIFIER STRAP

[76] Inventor: Jean S. Perry, 2972 N. 28th St., Milwaukee, Wis. 53210

[21] Appl. No.: 53,846

[22] Filed: May 26, 1987

[51] Int. Cl.[4] ..... A44B 21/00; A61J 17/00

[52] U.S. Cl. ..... 24/301; 24/3 M; 128/360

[58] Field of Search ..... 24/300, 301, 302, 298, 24/519, 561, 265 R, 265 EC, 265 AL, 3 R, 3 M, 3 J, 3 H, 17 A, 17 B; 128/359, 360; 224/252, 258, 262

[56] References Cited

U.S. PATENT DOCUMENTS

| | | | |
|---|---|---|---|
| 306,417 | 10/1884 | Moseley | 24/301 |
| 954,066 | 4/1910 | Ware | 128/360 |
| 1,287,295 | 12/1918 | Guenther | 128/360 |
| 1,782,057 | 11/1930 | Bollinger | 24/301 |
| 1,887,491 | 11/1932 | Johnson | 24/3 M |
| 2,595,462 | 5/1952 | Johnson | 128/359 |
| 2,608,692 | 9/1952 | Berg | 24/301 |
| 2,819,650 | 1/1958 | Seron | 24/3 C |
| 2,870,502 | 1/1959 | Sasse | 24/17 A |
| 3,392,729 | 7/1968 | Lenoir | 128/360 |
| 4,361,934 | 12/1982 | Darnell | 24/3 M |

FOREIGN PATENT DOCUMENTS

| | | | |
|---|---|---|---|
| 0002644 | of 1892 | United Kingdom | 24/298 |

*Primary Examiner*—Victor N. Sakran

*Attorney, Agent, or Firm*—Andrew S. McConnell

[57] ABSTRACT

A variable-length strap for removably attaching an article, such as a pacifier, to an item of a child's clothing is provided with a clip for attachment to the child's clothing. The strap may be constructed of a stretchable and elastic material, so that the length of the strap may be elongated in response to tensile forces exerted on the strap. A means for varying the base length of the strap includes a series of mating snap members disposed along the length of the strap.

2 Claims, 1 Drawing Sheet

PACIFIER STRAP

BACKGROUND AND SUMMARY

This invention relates to infant accessories, and more particularly to an accessory for use with a pacifier.

It is common for parents to use a pacifier for calming and pacifying an infant. The pacifier generally includes a nipple-shaped portion, a shield, and a ring or other such handle connected to the shield for manual handling of the pacifier.

A common problem in using a pacifier is that the infant may not want or need the pacifier in its mouth at all times. Or, there may be times when the pacifier accidentally falls from the infant's mouth. When the pacifier is not in use as mentioned, it is easy for the pacifier to be misplaced or otherwise removed from ready availability. This can be a cause of great concern to a parent, for when the infant again wants or needs the pacifier, the infant may make this fact known in a vocal and obtrusive manner.

Therefore, there is a need for a device which allows an infant's pacifier to be kept constantly at the ready in the general vicinity of the infant's mouth.

Accordingly, the present invention provides a pacifier strap which enables a parent or other care giver to removably attach a pacifier to an article of infant's clothing, such as a collar. The pacifier strap includes a retainer means, such as a clip, connected to a strap or other elongated tethering means, which is connected to a pacifier. In a typical embodiment, the strap is connected to the ring of the pacifier. The strap or tethering means is preferably constructed of an elastic material which is capable of stretching, so that the infant's movements are unrestricted. A means for varying the base length of the strap is provided, so that the device of the invention may be attached to different areas of the child's clothing, depending on what area is convenient at the time. In one embodiment, a series of snaps is provided for varying the base length of the strap. In another embodiment, a slidable ring arrangement is provided to vary base length of the strap.

BRIEF DESCRPTION OF THE DRAWINGS

The drawings illustrate the best mode presently contemplated of carrying out the invention.

DETAILED DESCRIPTION

Figure 1:
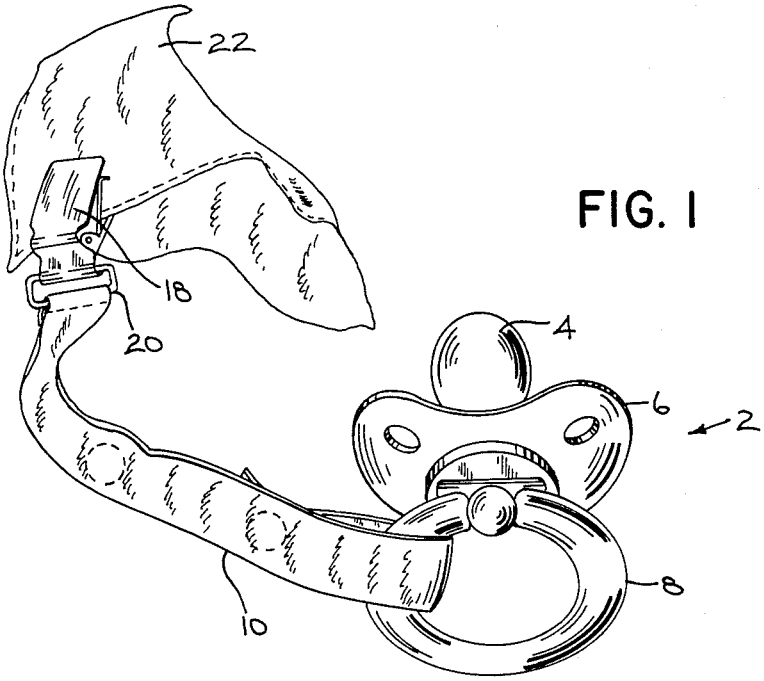
FIG. 1 is an elevation view showing one embodiment of the present invention.
Figure 2:
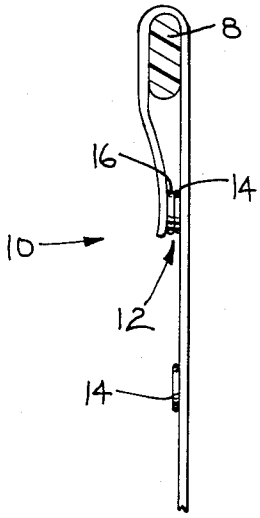
FIG. 2 is a side elevation view, partially in section, showing embodiment of the strap of FIG. 1.

A pacifier 2 typically includes a protruding nipple portion 4, a shield 6 and a holder, such as a ring 8, connected thereto. A pacifier strap 10 is adapted for attachment to ring 8 at one end, and to an article of a child's clothing at the other end.

The ring-engaging end of strap 10 may be looped through the interior of ring 8 and sewn together therearound for attachment to ring 8. In a preferred embodiment, however, the ring-engaging end of strap 10 is provided with a means for varying the base length of strap 10. As shown in FIG. 1, the means for varying the base length of strap 10 includes a series of snap receptors disposed along the length of strap 10. As is well known, a snap, such as shown at 12, typically includes a female snap portion 14 adapted to receive a male snap portion 16. The end of strap 10 is provided with a single male snap portion 16, while a series of female snap portions 14 are disposed along the length of strap 10. The end of strap 10 including male snap portion 16 is threaded through the opening in ring 8, and is engaged with the appropriate female snap portion 14 to provide the length of strap 10 desired.

Figure 3:
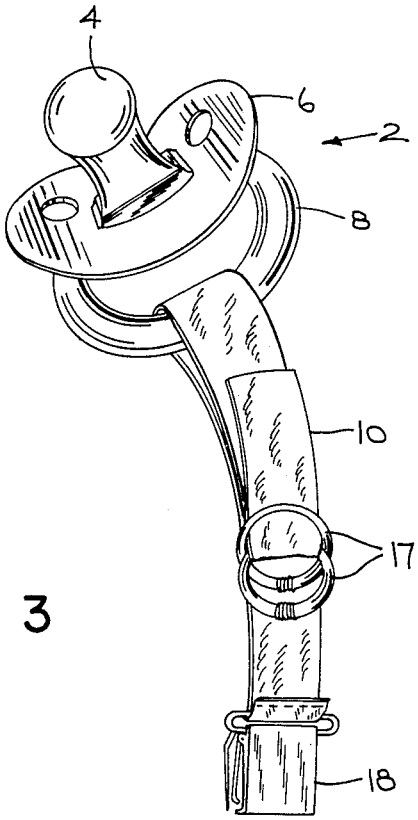
FIG. 3 is an elevation view showing an alternate embodiment of the invention.

An alternative means for varying the base length of strap 10 is shown in FIG. 3. A pair of rings 17 are anchored to strap 10 at a point along its length, preferably toward the clothing-engaging end of strap 10. The opposite end of strap 10 is then threaded through the opening in ring 8, and is subsequently threaded through the rings, as is well known. The base length of the strap may then be adjusted by pulling the end of strap 10 through the rings as desired, to shorten strap 10 to its desired length.

The clothing-engaging end of strap 10 is provided with a clip 18. Clip 18 has a ring 20 adapted to receive the clothing-engaging end of strap 10. This end of strap 10 is threaded through ring 20 and sewn upon itself, to provide a secure attachment of strap 10 to ring 20 and clip 18.

Clip 18 is a standard clip having a pair of opposed movable jaws and a clamping member for securing the jaws to an article of clothing. As shown in FIG. 1, the jaws of clip 18 may be secured to an article of clothing such as a collar 22 of a child's clothing, such as a jacket or the like.

Strap 10 may be formed from any material, but is preferably formed from a stretchable elastic material. This material is capable of stretching in response to applied tensile forces, but returns to its original or base length upon removal of the tensile force. A desirable material is common elastic as used in sewing applications. The stretchable feature of strap 10 allows strap 10 to "give" in response to a child's head movements when the pacifier is in the infant's mouth, so that the pacifier will not be abruptly removed from the mouth in response to such movements.

While the invention has been described with reference to an infant pacifier, it is recognized that the invention is useful for other articles such as teething rings or the like.

Various alternatives are contemplated as being within the scope of the following claims particularly pointing out and distinctly claiming the subject matter regarded as the invention.

I claim:

1. A retainer for tethering a pacifier to an article of clothing, comprising:

a resilient strap constructed of a stretchable material, said strap being capable of stretching in response to a tensile force applied thereto and of returning to its original length upon removal of said tensile force;

clip means for removably attaching said strap to said article of clothing;

ring means disposed between said clip means and said strap for connection to an end of said strap and to said clip means; and adjustment means provided on said strap for longintudinal varying the length of said strap between said ring means and said pacifier, said adjustment means comprising snap means including a first snap member provided adjacent the end of said strap opposite said end connected to said ring means, and a series of mating second snap members provided along said strap and adapted to receive said first snap member is engageable with said pacifier and said first snap member is mated with a selected one of said mating second snap members to longitudinally adjust the length of said strap.

2. A retainer for tethering a pacifier to an article of clothing, comprising:

a resilient strap constructed of a stretchable material, said strap being capable pf stretching in response to a tensile force applied thereto and of returning to its original length upon removal of said tensile force;

clip means for removably attaching said strap to said article of clothing;

ring means disposed between said clip means and said strap for connection to an end of said strap and to said clip means; and adjustment means for longitudinally varying the length of said strap between said ring means and said pacifier, said adjustment means comprising a pair of adjacent circular rings disposed adjacent the end of said strap connected to said ring means, with the other end of said strap being adapted for engagement with said pacifier and for threading through said adjacent circular rings to longitudinally adjust the length of said strap.

* * * * *